United States Patent [19]

Moertel

[11] 4,153,980

[45] May 15, 1979

[54] SELF-LUBRICATING SLIDE FASTENER

[75] Inventor: George B. Moertel, Conneautville, Pa.

[73] Assignee: Textron Inc., Providence, R.I.

[21] Appl. No.: 843,370

[22] Filed: Oct. 19, 1977

[51] Int. Cl.[2] ..... A44B 19/10

[52] U.S. Cl. ..... 24/205.16 C; 24/205.16 R; 139/384 B

[58] Field of Search ..... 24/205.16 R, 205.16 C

[56] References Cited

U.S. PATENT DOCUMENTS

| | | | |
|---|---|---|---|
| 2,061,683 | 11/1936 | Sipe | 24/205.16 R |
| 2,452,899 | 11/1948 | Brown | 24/201 C |
| 2,495,033 | 1/1950 | Sullivan | 24/205.13 R |
| 2,496,946 | 2/1950 | Legat | 24/205.16 R |
| 2,665,467 | 1/1954 | Bosomworth | 24/201 C |
| 3,590,881 | 7/1971 | Van Amburg | 24/205.16 C |
| 4,045,846 | 9/1977 | Moertel | 24/205.16 C |

*Primary Examiner*—Bernard A. Gelak
*Attorney, Agent, or Firm*—O'Brien and Marks

[57] ABSTRACT

Sorbent cords are saturated with a liquid lubricant and secured in the respective tapes of a slide fastener adjacent the coupling elements to provide lubrication for a slider of the slide fastener.

8 Claims, 6 Drawing Figures

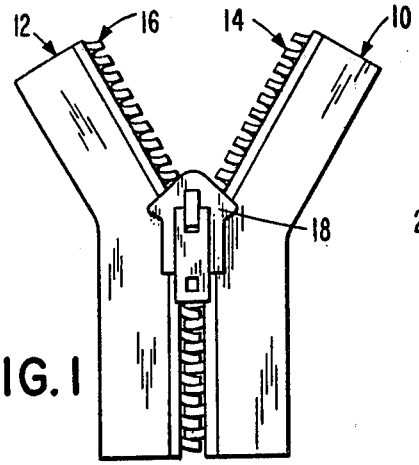
FIG. 1
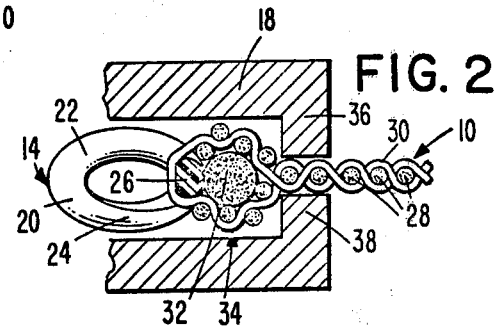
FIG. 2
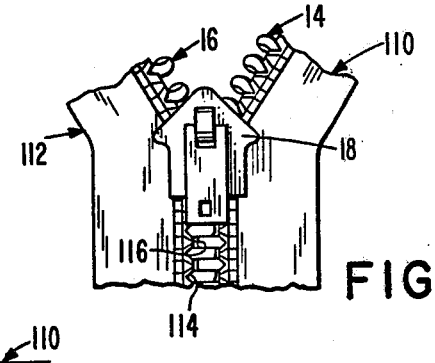
FIG. 3
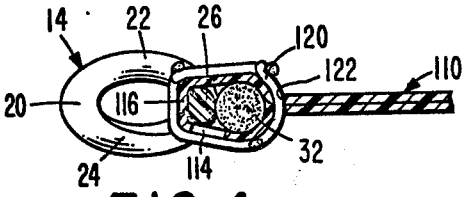
FIG. 4
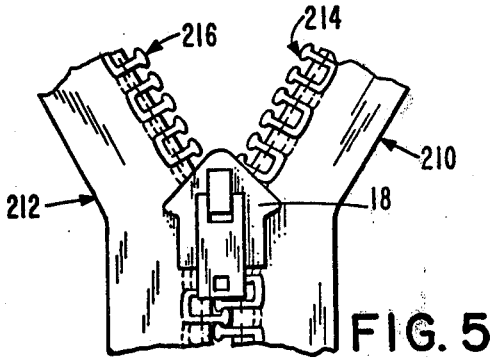
FIG. 5
FIG. 6
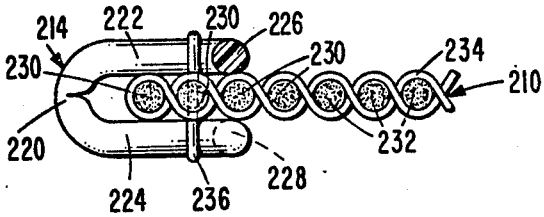

SELF-LUBRICATING SLIDE FASTENER

BACKGROUND OF THE INVENTION

1. Field of the Invention

The invention relates to slide fasteners and lubrication of slide fasteners.

2. Description of the Prior Art

Frictional forces between sliders and the tapes and/or fastening elements of slide fasteners result in wear and tear as well as increased difficulty in moving the sliders. In the prior art a number of techniques have been employed to reduce this wear and tear and to produce easier operation of the sliders. One such technique is to spray the surface of the slide fastener with a liquid lubricant. Another technique described in U.S. Pat. No. 3,590,881 is the employment of low frictional materials such as polytetrafluoroethylene threads or fibers in the tape to decrease frictional forces.

Self lubricating bearings employed in automobiles and other equipment are well known. U.S. Pat. No. 3,328,100 discloses a bearing including a fabric bearing liner having one face formed from low friction polytetrafluoroethylene threads with another face formed from high friction cotton fibers which can be bonded with a resin containing solid lubricant particles such as graphite, molybdenum sulfide and the like.

SUMMARY OF THE INVENTION

The invention is summarized in a self-lubricating slide fastener including a pair of planarly disposed carrier tapes, coupling means mounted on longitudinal inner edges of the pair of tapes, a slider slidably mounted on the coupling means for opening and closing the slide fastener, a sorbent cord extending longitudinally along at least one of the tapes, the cord secured adjacent to the interlocking means, and a liquid lubricant saturating the cord.

An object of the invention is to construct a slide fastener which is self-lubricating.

Another object of the invention is to eliminate the necessity of spraying a lubricant on a slide fastener.

It is also an object of the invention to eliminate the necessity of including expensive low-friction threads in the tapes of slide fasteners to provide for easy slider operation.

One advantage of the invention is that a cord saturated with a liquid lubricant provides a continuous supply of lubricant over a long duration of time.

Another feature of the invention is the saturation of a cord with lubricant prior to assembly of the slide fastener wherein the cord is formed as a part of the tape or support for the coupling elements of the slide fastener.

Other objects, advantages and features of the invention will be apparent from the following description of the preferred embodiment taken in conjunction with the accompanying drawings. BRIEF DESCRIPTION OF THE DRAWINGS FIG. 1 is a plan view of a slide fastener constructed in accordance with the invention.

FIG. 2 is a cross-section view of a portion of the slide fastener of FIG. 2.

FIG. 3 is a plan view of a portion of a modified slide fastener in accordance with the invention.

FIG. 4 is a cross-section view of a broken away portion of the slide fastener shown in FIG. 3.

FIG. 5 is a plan view of a portion of another modified slide fastener in accordance with the invention.

FIG. 6 is a cross section view of a portion of the slide fastener shown in FIG. 5.

DESCRIPTION OF THE PREFERRED EMBODIMENTS

As shown in FIG. 1, a slide fastener manufactured in accordance with the invention includes a pair of planarly disposed carrier tapes indicated generally at 10 and 12 with coupling elements indicated generally at 14 and 16 attached to the inner edges of the tapes 10 and 12. A slider 18 is slidably mounted on the elements 14 and 16 for opening and closing the slide fastener. The tape 12 and coupling element 16 are a mirror image of the tape 10 and coupling element 14; thus only the tape 10 and coupling element 14 are illustrated in detail in FIG. 2.

The coupling element 14 is a continuous spiral or coil coupling element formed from a filament suitably coiled and deformed into successive convolutions. Each convolution includes a head portion 20, a pair of leg portions 22 and 24 extending from opposite sides of the head portion 20 and a heel or interconnecting portion 26 joining adjacent convolutions of the coupling element. The tape 10 includes a plurality of warp threads 28 with a weft or filling thread 30 interwoven therewith and around the interconnecting portion 26. A cord 32 extends longitudinal along the tape 10 and is secured in the tape 10 by the weft thread 30 adjacent to the coupling element 14 with the heel portions 26 abutting the cord 32. The cord 32 and several of the warp threads 28 are bunched in a bundle or bead indicated generally at 34 providing a base or support for the heel portions 26. The slider 18 has slider flanges 36 and 38 which engage the head 34 during movement of the slider 18 in opening and closing of the slide fastener.

The cord 32 is formed from a sorbent material and is saturated with a liquid lubricant. The term "liquid lubricant" includes any liquid, grease, or gell which can be saturated in an absorbent cord or between fibers of an absorbent cord and subsequently dispensed or wicked through the threads forming the tape 10 to lubricate the surfaces engaging the slider 18. Non-volatile lubricants such as silicone-base lubricants are preferred for providing a relatively long period of lubrication. Sorbent materials include fibrous materials which absorb liquid in the fibers, such as cotton, and/or adsorb liquid by capillary action between fibers, such as polyester. The amount of lubricant in the cord 32 is selected to adequately lubricate the slide fastener but not to saturate and degrade the appearance of the slide fastener or garment to which the slide fastener is attached.

In the manufacture of the slide fastener of FIG. 1 the cords 32 are first saturated with the lubricant, and then woven with the coupling element 14, warp threads 28 and the weft thread 30. The weaving is performed by convention techniques. The force of the weaving during tightening of the weft thread 30 will dispense lubricant onto the surface of the bead 34 of the slide fastener. Subsequently during use of the slide fastener, the pressure from the slider 18 results in squeezing of the cord 32 to dispense further lubricant. This insures long life and continued ease of operation of the slide fastener.

In a modified slide fastener shown in FIGS. 3 and 4, tapes, indicated generally at 110 and 112, of longitudinally folded synthetic polymer film strips are substituted for the woven tapes. The tapes 110 and 112 have transverse slits 114 extending over the folded edge through which leg portions 22 and 24 of each convolution of the coupling elements 14 and 16 project. Looped strap portions 116 formed between successive slits 114 of the polymer strips extend around the connecting portions 26 of the coupling elements 14 and 16 to secure the coupling elements 14 and 16 in the folded edges of the polymer film tapes 110 and 112. The cords 32 are encircled and secured by the folded edges of the tapes 110 and 112 between the opposite folded portions or halves of the tapes 110 and 112 adjacent the coupling elements 14 and 16 and against the heel portions 26. The cords 32 contain a lubricant similar to that of the slide fastener of FIG. 2. The folded portions of the film strips 14 and 16 and the bundles formed by the cords 32 and the heel portions 26 are firmly secure together by overedge stitching 120. Lubricant is dispensed or wicked from the cords 32 through the slits 114 as well as through openings 122 through which the stitching 120 passes. This results in a coating of lubricant on the outside of the beads formed by the cords 32 to allow easy operation of the slider 18.

In another modified slide fastener illustrated in FIGS. 5 and 6, conventional coupling elements indicated generally at 214 and 216 of the meander type are formed from continuous filaments which are deformed into successive convolutions and secured on inner edges of respective carrier tapes indicated generally at 210 and 212. Each convolution of the elements 214 and 216 have a head portion 220 with a pair of leg portions 222 and 224 extending from opposite sides of the head portion 220 over the opposite sides of the respective tape 210 or 212. The leg portions 222 and 224 terminate in heel portions 226 and 228 which extend in opposite directions over the respective sides of the tape 210 or 212 to connect with the adjoining convolutions of the coupling element 214 or 216. The coupling elements 214 and 216 are secured to the tapes 210 and 212 by stitches 236 passing over the leg portions 222 and 224. The tapes 210 and 212 are formed from a plurality of warp threads or cords 230 and 232 and interwoven weft threads 234 into flat tapes. The warp cords 230 which are next to the inner edge of the tapes 210 and 212 are formed from a sorbent material and are saturated with a liquid lubricant in the same manner as described for the cord 32 in FIG. 2. During use of the slide fastener shown in FIG. 5 the lubricant is dispensed from the cords 230 onto the surfaces of the coupling elements 214 and 216, the tapes 210 and 212 adjacent to the coupling elements 214 and 216 and the stitching 236 to provide for easier operation of the slider 18 and to reduce failure of the threads forming the tapes 210 and 212 and stitching 236.

Since many modifications, variations and changes in detail may be made in the present invention, it is intended that all matter in the foregoing description and shown in the accompanying drawings be interpreted as illustrative and not in a limiting sense.

What is claimed is:

1. A self-lubricating slide fastener comprising a pair of planarly disposed carrier tapes, coupling means mounted on longitudinal inner edges of the pair of tapes, a slider slidably mounted on the coupling means for opening and closing the slide fastener, a sorbent cord extending longitudinally along at least one of the tapes, said cord secured adjacent to the coupling means, and a liquid lubricant saturating the cord, said carrier tapes including means surrounding said cord, which means is free of saturation of said liquid lubricant but provides for passage of the lubricant to needed surfaces of the slide fastener.

2. A slide fastener as claimed in claim 1 wherein there is included a second cord saturated with the liquid lubricant in the other tape and surrounded by the surrounding means of the tapes.

3. A slide fastener as claimed in claim 2 wherein the coupling means includes a pair of spiral coupling elements formed from a continuous filament, each of the tapes includes a plurality of warp threads and an interwoven weft thread passing around the respective coupling element and interwoven with the respective plurality of warp threads, and the surrounding means includes portions of the respective weft threads and several of the respective plurality of the warp threads adjacent to the respective coupling elements.

4. A slide fastener as claimed in claim 3 wherein the coupling elements have heel portions abutting the cords.

5. A slide fastener as claimed in claim 1 wherein the carrier tapes are formed from longitudinally folded polymer film strips having transverse slits defining looped strap portions extending transversely over the folded edges of the tapes, the coupling means includes a pair of continuous coupling elements having head portions protruding from the slits and having interconnecting portions extending through the looped strap portions, and there is included a second sorbent cord saturated with the liquid lubricant, said first and second cords being enclosed within the respective folded edges and abutting the interconnecting portions of the coupling elements for dispensing lubricant through the slits.

6. A slide fastener as claimed in claim 5 including stitching means securing folded portions of the tapes together, said stitching means passing through holes formed in the film strips and through which lubricant passes to the outside surface of the tape.

7. A slide fastener as claimed in claim 1 wherein the coupling means includes a pair of meander coupling elements formed from continuous filaments into successive convolutions each having a head portion, a pair of leg portions extending from opposite sides of the head portion, and heel portions extending in planes parallel to the tapes and interconnecting adjoining convolutions of the coupling elements.

8. A slide fastener as claimed in claim 7 wherein the leg portions and heel portions extend on respective opposite sides of the tapes, the tapes are each formed from a plurality of warp cords and an interwoven weft thread, at least one of the warp cords adjacent to the inner edge of each tape being saturated with the liquid lubricant, and stitching means attaching the coupling elements to the inner edges of the tapes.

* * * * *